US011114755B2

(12) United States Patent
Tsuchiya et al.

(10) Patent No.: US 11,114,755 B2
(45) Date of Patent: Sep. 7, 2021

(54) ANTENNA DEVICE WITH RADOME

(71) Applicant: DENSO TEN Limited, Kobe (JP)

(72) Inventors: Junzoh Tsuchiya, Kobe (JP); Masafumi Ibushi, Kobe (JP)

(73) Assignee: DENSO TEN Limited, Kobe (JP)

( * ) Notice: Subject to any disclaimer, the term of this patent is extended or adjusted under 35 U.S.C. 154(b) by 0 days.

(21) Appl. No.: 16/794,302

(22) Filed: Feb. 19, 2020

(65) Prior Publication Data

US 2020/0365980 A1 Nov. 19, 2020

(30) Foreign Application Priority Data

May 17, 2019 (JP) ..... JP2019-093803

(51) Int. Cl.
*H01Q 1/42* (2006.01)
*H01Q 1/32* (2006.01)

(52) U.S. Cl.
CPC ..... *H01Q 1/42* (2013.01); *H01Q 1/3283* (2013.01)

(58) Field of Classification Search
CPC ..... H01Q 1/42; H01Q 1/3283
USPC ..... 343/700 R
See application file for complete search history.

(56) References Cited

U.S. PATENT DOCUMENTS 10,367,258 B2 * 7/2019 Tagi ..... H01Q 15/02
10,804,615 B2 * 10/2020 Shiozaki ..... H01Q 1/42

FOREIGN PATENT DOCUMENTS

JP 2009-103457 A 5/2009

* cited by examiner

*Primary Examiner* — Peguy Jean Pierre
(74) *Attorney, Agent, or Firm* — Maier & Maier, PLLC

(57) ABSTRACT

An antenna device includes: a substrate at which a transmission antenna and a reception antenna are provided; and a radome provided facing the substrate, the radome includes: a transmission side radome facing the transmission antenna; and a reception side radome facing the reception antenna, and a region in which a gain is increased as compared with a case in which the radome is not provided in a beam pattern in a plane of the transmission antenna including a predetermined direction and a region in which a gain is increased as compared with a case in which the radome is not provided in a beam pattern in the plane of the reception antenna are at different angular positions.

19 Claims, 9 Drawing Sheets

ANTENNA DEVICE WITH RADOME

CROSS-REFERENCE TO RELATED APPLICATIONS

This application is based on and claims priority under 35 USC 119 from Japanese Patent Application No. 2019-093803 filed on May 17, 2019.

TECHNICAL FIELD

The present invention relates to an antenna device.

BACKGROUND ART

Conventionally, a substrate at which an antenna is provided may be covered with a radome for a purpose of protecting the antenna.

For example, JP-A-2009-103457 discloses a cover member that covers a transmission antenna and a reception antenna from a transmission direction side of transmission waves. The cover member is not in contact with a radar device, and has a transmission part that transmits the transmission waves. An installation angle of the transmission part is an inclination angle of 3 degrees or more with respect to an antenna surface of the reception antenna. The transmission part of the cover member and the antenna surface of the reception antenna have a predetermined inclination angle, it is possible to make it difficult to generate standing waves due to the transmission wave being repeatedly reflected between the antenna surface and the cover member.

SUMMARY OF INVENTION

For example, when the flat radome covering the substrate at which the antenna surface is provided in parallel to a vertical direction (an upper-lower direction) is inclined with respect to the vertical direction, a part of a beam emitted from the antenna is reflected in the vertical direction by the radome. As a result, a side lobe may become large in a vertical beam pattern.

Accordingly, in view of the above circumstance, an aspect of the present invention provides a technology capable of controlling a change in antenna characteristic by providing a radome.

An antenna device according to an aspect of the present invention comprises: a substrate at which a transmission antenna and a reception antenna are provided; and a radome provided facing the substrate, wherein the radome includes: a transmission side radome facing the transmission antenna; and a reception side radome facing the reception antenna, and wherein a region in which a gain is increased as compared with a case in which the radome is not provided in a beam pattern in a plane of the transmission antenna including a predetermined direction and a region in which a gain is increased as compared with a case in which the radome is not provided in a beam pattern in the plane of the reception antenna are at different angular positions (first configuration).

Further, it is preferable that, in the antenna device according to the first configuration, the beam pattern of the transmission antenna has, at an angular position on one side with respect to a main lobe, a first change region in which a gain is increased as compared with the case in which the radome is not provided, and the beam pattern of the reception antenna has, at an angular position on the other side with respect to the main lobe, a second change region in which a gain is increased as compared with the case in which the radome is not provided (second configuration).

Further, it is preferable that, in the antenna device according to the second configuration, the first change region is at least partially contained in a side lobe adjacent to the main lobe in the beam pattern of the transmission antenna, and the second change region is at least partially contained in a side lobe adjacent to the main lobe in the beam pattern of the reception antenna (third configuration).

Further, it is preferable that, in the antenna device according to the second or third configuration, the first change region is located in an angle region at least partially overlapping with an angle region in which a valley is formed in the beam pattern of the reception antenna, and the second change region is located in an angle region at least partially overlapping with an angle region in which a valley is formed in the beam pattern of the transmission antenna (fourth configuration).

Further, it is preferable that, in the antenna device according to any one of the first to fourth configurations, the transmission side radome and the reception side radome are inclined in the predetermined direction with respect to a surface of the substrate at which the transmission antenna and the reception antenna are provided, and the transmission side radome and the reception side radome are reversely inclined with respect to the substrate (fifth configuration).

Further, it may be that, in the antenna device according to the fifth configuration, the transmission side radome and the reception side radome are provided symmetrically with respect to a plane orthogonal to the predetermined direction (sixth configuration).

Further, it may be that, in the antenna device according to the fifth configuration, the transmission side radome and the reception side radome are provided asymmetrically with respect to a plane orthogonal to the predetermined direction (seventh configuration).

Further, it may be that, in the antenna device according to the seventh configuration, the transmission side radome and the reception side radome have different thicknesses (eighth configuration).

Further, it is preferable that, in the antenna device according to any one of the fifth to eighth configurations, the radome has a convex shape in which a boundary position between the transmission side radome and the reception side radome is farthest from the substrate in a cross-sectional view of a cut surface orthogonal to the surface of the substrate at which the transmission antenna and the reception antenna are provided (ninth configuration).

Further, it may be that, in the antenna device according to any one of the first to ninth configurations, a surface of at least one of the transmission side radome or the reception side radome facing the substrate has a concavo-convex structure or a curved surface structure (tenth configuration).

Further, it is preferable that, in the antenna device according to any one of the first to tenth configurations, the transmission antenna and the reception antenna include a transmission line and a plurality of antenna elements electrically connected to the transmission line, and the plurality of antenna elements are arranged along the predetermined direction (eleventh configuration).

According to the present invention, it is possible to control the change in antenna characteristic by providing the radome.

DETAILED DESCRIPTION OF THE INVENTION

Hereinafter, an exemplary embodiment of the present invention will be described in detail with reference to the drawings.

1. Overview of Antenna Device

Figure 1:
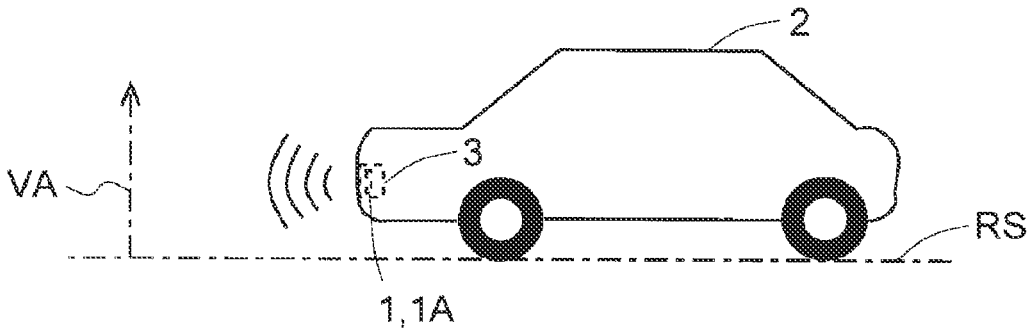
FIG. 1 is a schematic view illustrating an overview of an antenna device.

FIG. 1 is a schematic view illustrating an overview of antenna devices 1, 1A according to an embodiment of the present invention. The antenna devices 1, 1A are mounted at a radar device 3 configured to scan a front of a vehicle 2. However, a radar device at which the antenna device according to the present invention is mounted may scan a direction other than the front. The radar device at which the antenna device according to the present invention is mounted may be mounted at a moving body other than the vehicle 2. The vehicle may include, in addition to a vehicle, a robot, a ship, an aircraft, and the like. The radar device at which the antenna device according to the present invention is mounted may be an infrastructure radar device, a ship monitoring radar device, an aircraft monitoring radar device, or the like that is provided at a road or the like.

The radar device 3 is mounted at a front portion of the vehicle 2. The antenna devices 1, 1A are configured to transmit radio waves in a millimeter wave band to the front of the vehicle 2. The antenna devices 1, 1A are configured to receive radio waves reflected by a target object which is a preceding vehicle, an oncoming vehicle, or a roadside object. The antenna devices 1, 1A are mounted at the vehicle 2 in a state in which a substrate surface at which an antenna is formed is orthogonal to a horizontal road surface RS.

In the present specification, a direction VA orthogonal to a horizontal plane is referred to as a vertical direction. At a substrate surface on which the antenna is formed and which is provided in a direction parallel to the vertical direction, a direction parallel to the horizontal plane may be referred to as a left-right direction, and the direction parallel to the vertical direction may be referred to as an upper-lower direction. In the present specification, upper and lower sides are defined by reception antennas 12 being below transmission antennas 11 in FIG. 3. These directions are merely names used for description, and are not intended to limit an actual positional relationship and an actual direction.

2. First Embodiment

Figure 2:
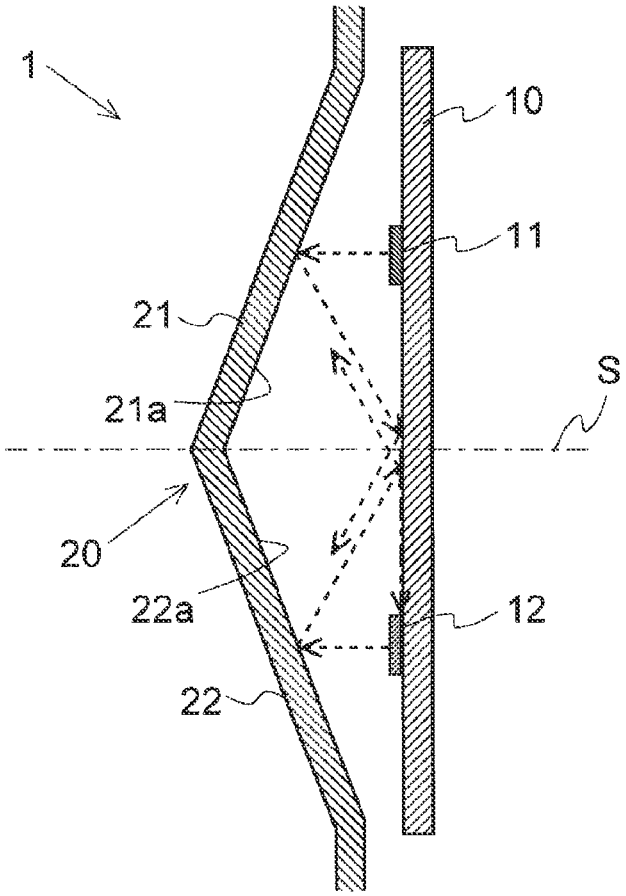
FIG. 2 is a schematic longitudinal sectional view illustrating a configuration of an antenna device according to a first embodiment.

FIG. 2 is a schematic longitudinal sectional view illustrating a configuration of the antenna device 1 according to the first embodiment of the present invention. As illustrated in FIG. 2, the antenna device 1 includes a substrate 10 and a radome 20.

Figure 3:
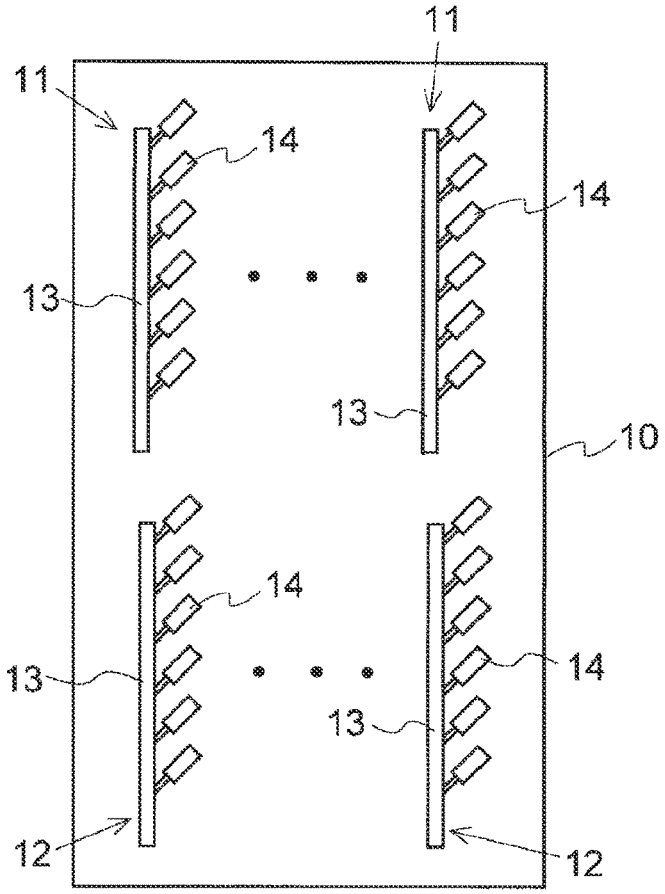
FIG. 3 is a schematic plan view of a substrate provided in the antenna device.

FIG. 3 is a schematic plan view of the substrate 10 provided in the antenna device 1 according to the first embodiment of the present invention. FIG. 3 is a front view of the substrate 10. The substrate 10 is specifically a dielectric substrate. The substrate 10 is provided with the transmission antennas 11 and the reception antennas 12. The transmission antennas 11 are configured to transmit radio waves. The reception antennas 12 are configured to receive radio waves. In the present embodiment, the transmission antennas 11 and the reception antennas 12 are provided at a front surface of the substrate 10. The transmission antennas 11 and the reception antennas 12 are provided in the upper-lower direction (the vertical direction).

The number of the transmission antennas 11 and the number of the reception antenna 12 may be one or more. The number of the transmission antennas 11 and the number of the reception antennas 12 may be the same or different from each other. The transmission antenna 11 and the reception antenna 12 may have the same position in the left-right direction, or may be shifted in the left-right direction. The transmission antenna 11 and the reception antenna 12 may have the same shape or different shapes.

Each of the transmission antennas 11 and the reception antennas 12 includes a transmission line 13 and a plurality of antenna elements 14. In the present embodiment, the transmission line 13 configured to transmit radio waves extends in the upper-lower direction (the vertical direction). The plurality of antenna elements 14 are arranged in the upper-lower direction (the vertical direction) at a lateral side of the transmission line 13 in the left-right direction. Each antenna element 14 is electrically connected to the transmission line 13. According to the present embodiment, beams at the transmission antennas 11 and the reception antennas 12 may be narrowed in the vertical direction.

A ground conductor plate (not illustrated) is provided at an opposite side of the substrate 10 from the surface (may be referred to as an antenna surface below) at which the antennas 11, 12 are provided. Thus, the transmission antenna 11 and the reception antenna 12 are planar antennas using microstrip lines. The radio waves transmitted from the transmission antenna 11 passes through the radome 20, so that an outside of the antenna device 1 is irradiated with the radio waves. Reflected radio waves obtained by reflecting the radio wave by a target is received by the reception antenna 12, so that a position, a relative speed, and the like of the target may be detected.

As illustrated in FIG. 2, the radome 20 faces the substrate 10. In the present embodiment, the radome 20 is provided in front of the substrate 10 and covers the substrate 10. The radome 20 is formed of a member which is a resin having high transmittance of radio waves or the like. Accordingly, most of the radio waves radiated from the antennas 11, 12 pass through the radome 20. However, as indicated by broken lines in FIG. 2, a part of the radio waves radiated from the antennas 11, 12 is reflected by the radome 20 instead of passing through the radome 20. The radio wave reflected by the radome 20 is reflected again by the substrate 10 and is radiated again forward of the substrate. Therefore, the radome 20 is provided, so that the radio waves reflected in an unnecessary direction interferes with the transmitted radio wave, and a beam pattern of the antenna changes. As a result, characteristics of a radar may be adversely affected. The radome 20 according to the present embodiment may prevent the adverse effect of the radio waves reflected by the radome 20.

The radome 20 includes a transmission side radome 21 and a reception side radome 22. The transmission side radome 21 faces the transmission antenna 11. The reception radome 22 faces the reception antenna 12. In the present embodiment, the transmission side radome 21 is provided in front of and away from the transmission antenna 11. The reception radome 22 is provided in front of and away from the reception antenna 12. The transmission side radome 21 and the reception side radome 22 have a flat plate shape. As will be described below, the reception side radome 22 has a reflection characteristic for radio waves that is different from that of the transmission side radome 21.

In the present embodiment, the transmission side radome 21 and the reception side radome 22 are arranged in the upper-lower direction (the vertical direction) according to the arrangement of the transmission antenna 11 and the reception antenna 12. The transmission side radome 21 and the reception side radome 22 are the same members. Thus, the transmission side radome 21 and the reception side radome 22 are integrally formed.

The transmission side radome 21 and the reception side radome 22 are inclined in a predetermined direction with respect to the surface (the antenna surface) of the substrate 10 at which the transmission antenna 11 and the reception antenna 12 are provided. The change in the beam pattern is prevented in the predetermined direction. Thus, in the present invention, the change in the beam pattern in a plane including the predetermined direction is prevented. Specifically, in the present embodiment, in order to prevent the change in the beam pattern in the vertical direction as described below, the predetermined direction is set to be the vertical direction. More specifically, the radome 20 according to the present embodiment prevents an increase in side lobe gain in the beams narrowed to a narrow angle. Therefore, the beams are narrowed in the predetermined direction. Thus, antenna elements 14 are arranged at each of the transmission antennas 11 and the reception antennas 12 in FIG. 3 in the predetermined direction. In other words, in the present embodiment, the antenna elements 14 are arranged along the predetermined direction.

In the present embodiment, the transmission side radome 21 and the reception side radome 22 are both inclined with respect to the antenna surface in the vertical direction that is the predetermined direction. At this time, the transmission side radome 21 and the reception side radome 22 are inclined in opposite orientations with respect to the substrate 10. Accordingly, the transmission side radome 21 and the reception side radome 22 have different reflection characteristics. Specifically, the transmission side radome 21 includes an inclined surface 21*a* that increases in distance (a distance in a front-rear direction) from the substrate 10 from the upper side toward the lower side. The reception radome 22 includes an inclined surface 22*a* that increases in distance (a distance in the front-rear direction) from the substrate 10 from the lower side toward the upper side. The inclined surfaces 21*a*, 22*a* are reflection surfaces configured to reflect the radio waves from the antennas 11, 12. In the present embodiment, reflection directions of the radio waves are opposite between the reflection surface 21*a* of the transmission side radome 21 and the reflection surface 22*a* of the reception side radome 22. As a result, in a reverse transmission reception synthesis beam pattern, an influence of multiple reflection of the radio waves may also be reduced in the vertical direction. The multiple reflection is a phenomenon in which the radio waves are repeatedly reflected between the antenna surface and the radome 20.

In the present embodiment, the radome 20 includes a part extending upward from an upper end of the transmission side radome 21 and a part extending downward from a lower end of the reception side radome 22, but these portions may not be provided.

The radome 20 has a convex shape in which a boundary position between the transmission side radome 21 and the reception side radome 22 is farthest from the substrate 10 in a cross-sectional view of a cut surface orthogonal to the surface (the antenna surface) of the substrate 10 at which the transmission antenna 11 and the reception antenna 12 are provided. By using the convex shape, it is possible to make it difficult for foreign matter which is a water droplet, dust, or the like to be collected in the radome 20 including the transmission side radome 21 and the reception side radome 22 that are inclined in the opposite orientations. However, the radome 20 may have a concave shape in which the boundary position between the transmission side radome 21 and the reception side radome 22 is closest to the substrate 10 in the cross-sectional view of the cut surface orthogonal to the antenna surface.

In the present embodiment, the transmission side radome 21 and the reception side radome 22 are provided symmetrically with respect to a plane orthogonal to the predetermined direction. Specifically, the transmission side radome 21 and the reception side radome 22 are provided symmetrically with respect to a plane S orthogonal to the vertical direction. The transmission side radome 21 and the reception side radome 22 have the same thickness. In this configuration, the radome 20 may have a symmetrical shape.

Figure 4:
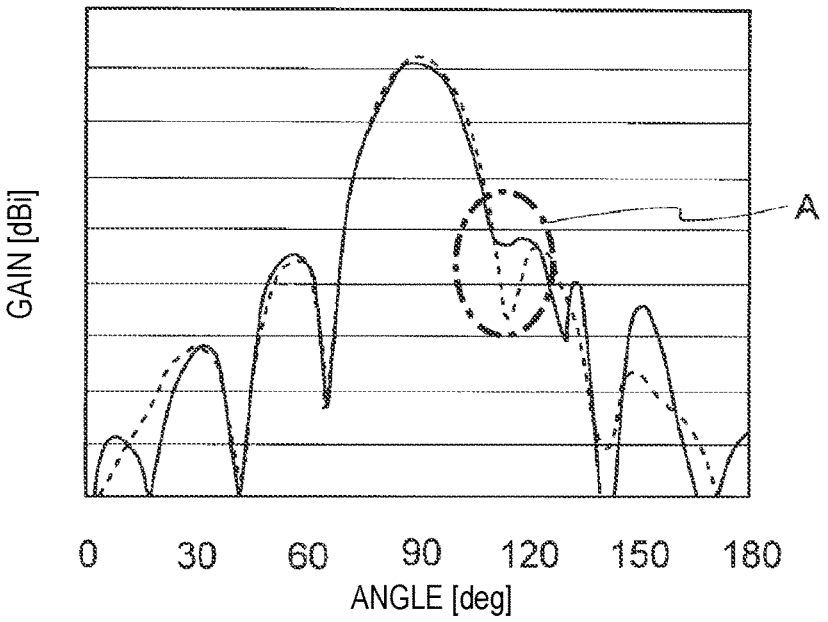
FIG. 4 shows a beam pattern on a vertical plane of a transmission antenna in the antenna device according to the first embodiment.
Figure 5:
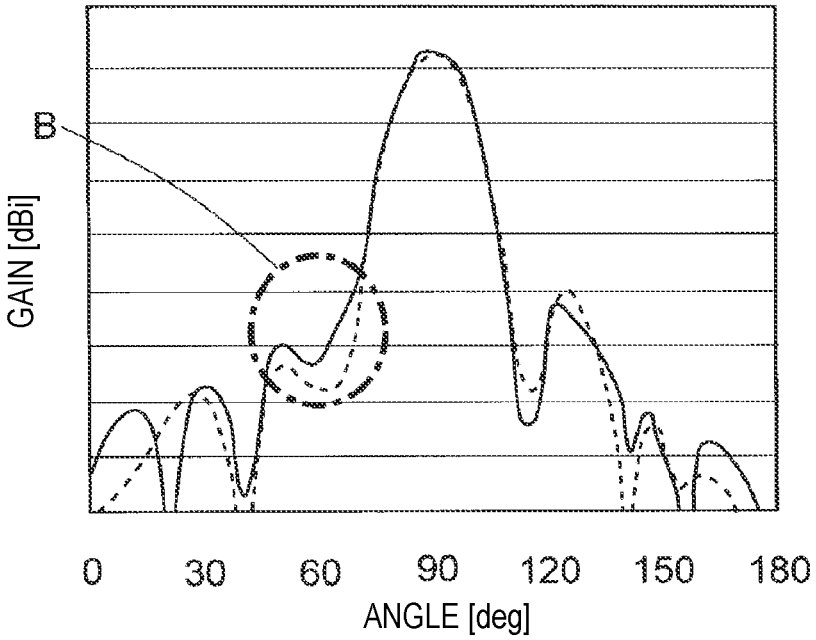
FIG. 5 shows a beam pattern on a vertical plane of a reception antenna in the antenna device according to the first embodiment.

FIG. 4 shows a beam pattern on a vertical plane of the transmission antenna 11 in the antenna device 1 according to the first embodiment. FIG. 5 shows a beam pattern on a vertical plane of the reception antenna 12 in the antenna device 1 according to the first embodiment. In the present embodiment, the vertical direction is set to be the predetermined direction, so that the beam pattern on a vertical plane is considered with a vertical plane being a plane including the predetermined direction. In FIGS. 4 and 5, a horizontal axis is an angle with respect to the vertical direction. An angle of a directly upper side with respect to the vertical direction is set to be 0°, and an angle of a directly lower side with respect to the vertical direction is set to be 180°. An angle of a horizontal direction with respect to the vertical direction is 90°. A vertical axis is a gain [dBi] of the antenna. A vertical plane is also selected to be orthogonal to the substrate 10. In FIGS. 4 and 5, a solid line is a beam pattern when the radome 20 is provided, and a broken line is a beam pattern when the radome 20 is not provided. Hereinafter, the beam pattern on a vertical plane is referred to as a vertical beam pattern. In the present embodiment, the vertical plane is selected to be orthogonal to the substrate 10, but is not limited thereto. When there is an angle of interest in a beam pattern on the horizontal plane, for example, a vertical plane along the angle may be selected.

As shown in FIGS. 4 and 5, in the antenna device 1, an angular position of a region where the gain is increased as compared with a case in which the radome 20 is not provided is different between the vertical beam pattern of the transmission antenna 11 and the vertical beam pattern of the reception antenna 12. Thus, in the antenna device 1, the vertical beam pattern of the transmission antenna 11 and the vertical beam pattern of the reception antenna 12 are different in angular position where the gain is increased as compared with the case in which the radome 20 is not provided.

According to the present embodiment, the angular position where the gain is increased by providing the radome 20 is different between the transmission antenna 11 and the reception antenna 12. Therefore, according to the present embodiment, an occurrence of an angular position where the gain is unnecessarily increased may be prevented by providing the radome 20 in a transmission reception synthesis beam pattern.

In the transmission antenna 11 shown in FIG. 4, for example, in a region in a vicinity of an angular position 110°, the gain is increased by providing the radome 20 as compared with the case in which the radome 20 is not provided. On the other hand, in the reception antenna 12 shown in FIG. 5, in the region in the vicinity of the angular position 110°, the gain is slightly smaller by providing the radome 20 as compared with the case in which the radome 20 is not provided. In the reception antenna 12, for example, in a region in a vicinity of an angular position 60°, the gain is increased by providing the radome 20 as compared with the case where the radome 20 is not provided.

In other words, the vertical beam pattern of the transmission antenna 11 has a first change region A in which the gain is increased as compared with the case in which the radome 20 is not provided at an angular position on one side with respect to a main lobe. In an example shown in FIG. 4, the main lobe is a part of a beam pattern having a peak in a vicinity of an angular position 90°. The first change region A is generated at an angle position side whose angle is larger than that of the peak of the main lobe. The vertical beam pattern of the reception antenna 12 has a second change region B in which the gain is increased as compared with the case in which the radome 20 is not provided at an angular position on the other side with respect to the main lobe. In an example shown in FIG. 5, the main lobe is a part of the beam pattern having a peak in the vicinity of 90°. The second change region B is generated at an angular position side whose angle is smaller than that of the peak of the main lobe. According to the present embodiment, an occurrence of a side lobe where the gain is unnecessarily increased may be prevented by providing the radome 20 in the transmission reception synthesis beam pattern.

Specifically, the first change region A is at least partially contained in a side lobe adjacent to the main lobe in the vertical beam pattern of the transmission antenna 11. The second change region B is at least partially contained in a side lobe adjacent to the main lobe in the vertical beam pattern of the reception antenna 12. Accordingly, an increase in gain of the side lobe adjacent to the main lobe may be prevented by providing the radome 20 in the transmission reception synthesis beam pattern. Thus, in the present embodiment, an increase in gain of the side lobe having a large influence of the increase in gain may be prevented in the transmission reception synthesis beam pattern.

Figure 6:
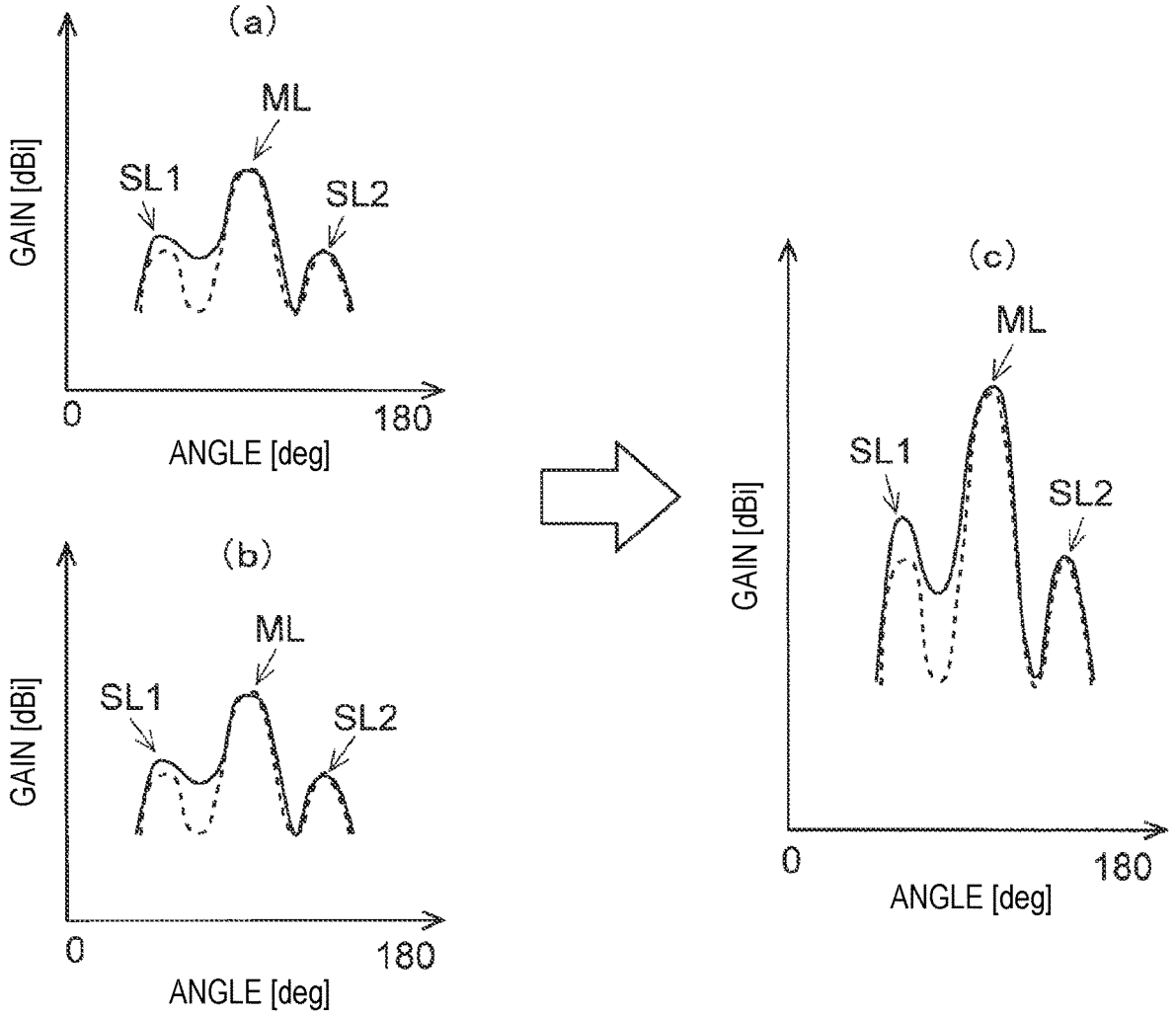
FIG. 6 is a schematic view showing operation of a radome in an antenna device according to a comparative example.
Figure 7:
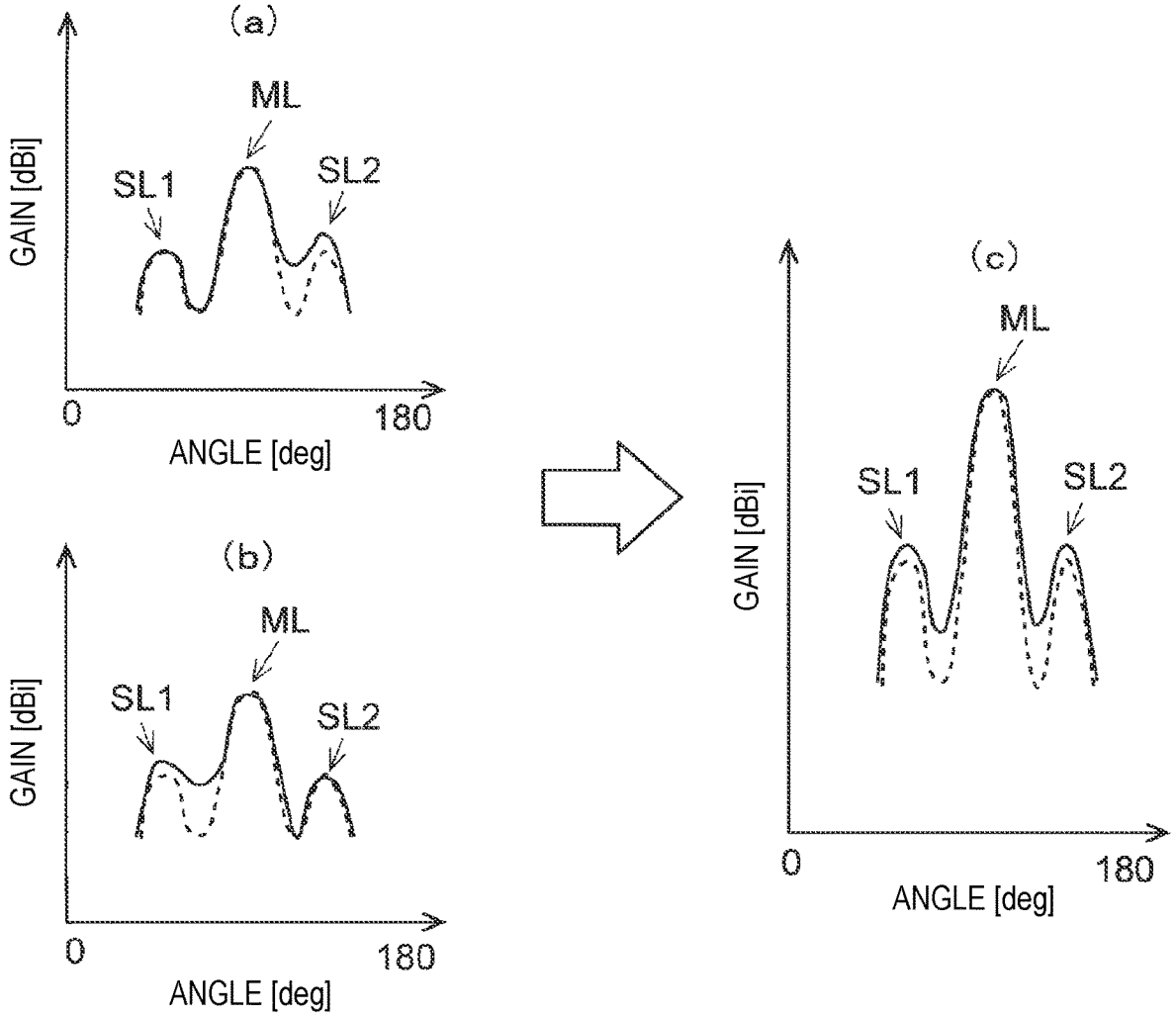
FIG. 7 is a schematic view showing operation of a radome in the antenna device according to the first embodiment.

Operation and effect of the radome 20 according to the present embodiment will be further described with reference to FIGS. 6 and 7. FIG. 6 is a schematic view showing operation of a radome in an antenna device according to a comparative example. FIG. 7 is a schematic view showing operation of the radome 20 in the antenna device 1 according to the first embodiment. Beam patterns shown in FIGS. 6 and 7 are schematically shown to facilitate understanding of the operation, and both are vertical beam patterns. In FIGS. 6 and 7, beam patterns when the radome is provided are indicated by solid lines. In FIGS. 6 and 7, beam patterns when the radome is not provided are indicated by broken lines. (a) of FIG. 6 and (a) of FIG. 7 are beam patterns of transmission antennas. (b) of FIG. 6 and (b) of FIG. 7 are beam patterns of reception antennas. (c) of FIG. 6 and (c) of FIG. 7 are transmission reception synthesis beam patterns.

In the antenna device according to the comparative example, a transmission side radome facing the transmission antenna and a reception radome facing the reception antenna are inclined in the same orientation in the vertical direction. Specifically, the radome including the transmission side radome and the reception side radome includes one inclined surface that increases in distance (a distance in the front-rear direction) from the substrate 10 from a lower side toward an upper side. The transmission side radome and the reception side radome have the same thickness.

As shown in FIG. 6, in the vertical beam pattern (see (a) of FIG. 6) of the transmission antenna in the antenna device according to the comparative example, a gain of a first side lobe SL1 at a side whose angle is smaller than that of a main lobe ML is increased by providing the radome. However, a gain of a second side lobe SL2 at a side whose angle is larger than that of the main lobe ML does not change greatly depending on presence or absence of the radome. Also, in the vertical beam pattern (see (b) of FIG. 6) of the reception antenna, a gain of the first side lobe SL1 at a side whose angle is smaller than that of the main lobe ML is increased by providing the radome. However, a gain of the second side lobe SL2 at a side whose angle is larger than that of the main lobe ML does not change greatly depending on presence or absence of the radome.

Thus, in both the vertical beam pattern of the transmission antenna and the vertical beam pattern of the reception antenna, the gain of the same side lobe (the first side lobe SL1) is increased by providing the radome. Therefore, in the transmission reception synthesis beam pattern (see (c) of FIG. 6), a peak of the first side lobe SL1 is closer to a peak of the main lobe ML when the radome is provided as compared with the case in which the radome is not provided. When an approach amount of the peak of the first side lobe SL1 with respect to the peak of the main lobe ML increases, for example, a situation, in which a target at an angle that is not to be detected is detected, or the like may occur.

As shown in FIG. 7, in the vertical beam pattern of the transmission antenna 11 (see (a) of FIG. 7) in the antenna device 1 according to the present embodiment, a gain of the first side lobe SL1 at a side whose angle is smaller than that of the main lobe ML does not change greatly depending on presence or absence of the radome 20. However, a gain of the second side lobe SL2 at a side whose angle is larger than that of the main lobe ML is increased by providing the radome 20. On the other hand, in the vertical beam pattern (see (b) of FIG. 7) of the reception antenna 12, a gain of the first side lobe SL1 at a side whose angle is smaller than that of the main lobe ML is increased by providing the radome 20. However, a gain of the second side lobe SL2 at a side whose angle is larger than that of the main lobe ML does not change greatly depending on presence or absence of the radome 20.

Thus, the side lobes SL1, SL2 whose gain is increased by providing the radome 20 are different between the vertical beam pattern of the transmission antenna 11 and the vertical beam pattern of the reception antenna 12. Therefore, in the transmission reception synthesis beam pattern (see (c) of FIG. 7), the gain of both side lobes SL1, SL2 does not increase greatly as in the comparative example by providing the radome 20. Thus, the peak of any of the side lobes SL1, SL2 does not greatly approach the peak of the main lobe ML, and antenna characteristics may be prevented from greatly changing by providing the radome 20.

3. Second Embodiment

Next, an antenna device 1A according to a second embodiment will be described. In a description of the second embodiment, the same members as those in the first embodiment are denoted by the same reference numerals, and a description thereof will be omitted if there is no need for the description. The same contents as those in the first embodiment will be omitted as much as possible.

Figure 8:
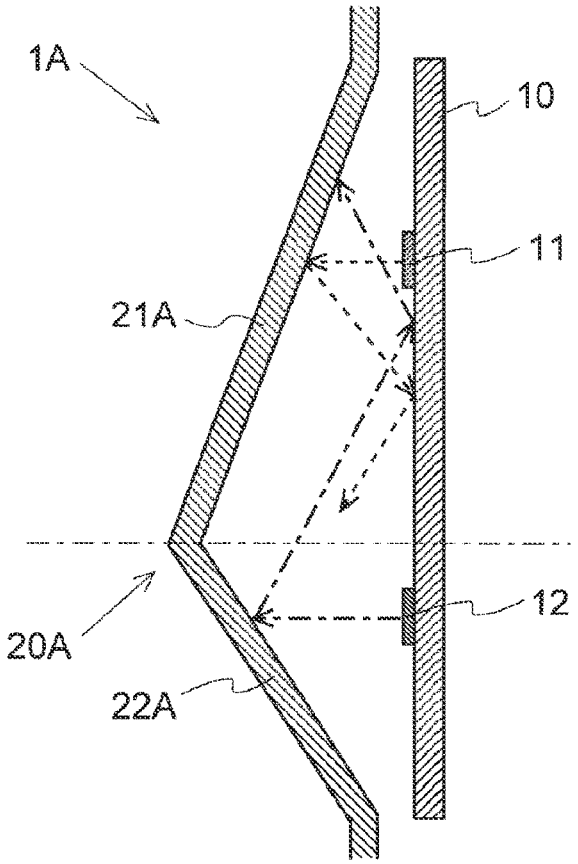
FIG. 8 is a schematic longitudinal sectional view illustrating a configuration of an antenna device according to a second embodiment.

FIG. 8 is a schematic longitudinal sectional view illustrating a configuration of the antenna device 1A according to the second embodiment of the present invention. As illustrated in FIG. 8, the antenna device 1A includes the substrate 10 and a radome 20A. A configuration of the substrate 10 is the same as that in the first embodiment, a description thereof will be omitted.

As in the first embodiment, the radome 20A is provided in front of the substrate 10 and covers the substrate 10. The radome 20A includes a transmission side radome 21A facing the transmission antenna 11, and a reception side radome 22A that faces the reception antenna 12 and has a function different from that of the transmission side radome 21A. The transmission side radome 21A and the reception side radome 22A have a flat plate shape and have the same thickness. The transmission side radome 21A and the reception side radome 22A are arranged in the upper-lower direction (the vertical direction). The transmission side radome 21A and the reception side radome 22A are inclined with respect to the antenna surface in the vertical direction. The transmission side radome 21A and the reception side radome 22A are reversely inclined with respect to the antenna surface. The transmission side radome 21A and the reception side radome 22A are the same members.

In the present embodiment, the transmission side radome 21A and the reception side radome 22A are provided asymmetrically with respect to the plane S orthogonal to a predetermined direction. Accordingly, a shape of the radome 20 may be determined according to the characteristics of the transmission antenna 11 and the reception antenna 12, and a degree of design freedom is improved. In the present embodiment, the predetermined direction is also the upper-lower direction (the vertical direction).

The transmission side radome 21A and the reception side radome 22A may be provided symmetrically with respect to the plane S orthogonal to the predetermined direction. Whether the transmission side radome 21A and the reception side radome 22A are arranged symmetrically or asymmetrically is determined based on the vertical beam pattern of the transmission antenna 11 and the vertical beam pattern of the reception antenna 12.

Figure 9:
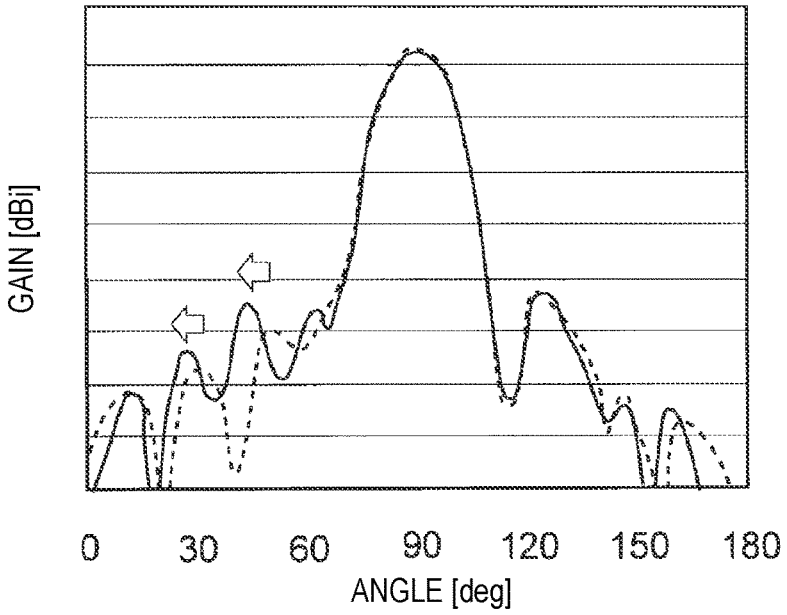
FIG. 9 illustrates a change in a vertical beam pattern of the reception antenna when an amount of inclination of the reception side radome with respect to the vertical direction is changed.

FIG. 9 illustrates a change in the vertical beam pattern of the reception antenna 12 when an amount of inclination of the reception side radome 22A with respect to the vertical direction is changed. In FIG. 9, a horizontal axis is an angle in the vertical direction, and a vertical axis is a gain [dBi] of the antenna. A broken line in FIG. 9 is a vertical beam pattern when the inclination of the reception side radome 22A with respect to the vertical direction is the same as that in the first embodiment. A solid line in FIG. 9 is a vertical beam pattern when the inclination of the reception side radome 22A with respect to the vertical direction is increased as compared with that indicated by the broken line in FIG. 9.

As indicated by thick arrows in FIG. 9, the inclination of the reception side radome 22A with respect to the vertical direction is increased, so that an angular position of a side lobe fluctuates particularly in a region whose angle is smaller than that of the main lobe. Specifically, the angular position of the side lobe is moved to a low angular position in the region whose angle is smaller than that of the main lobe by increasing the inclination of the reception side radome 22A with respect to the vertical direction. Thus, the position of the side lobe where the gain is increased by providing the radome 20A may be adjusted by adjusting the inclination of the reception side radome 22A with respect to the vertical direction.

Although illustration is omitted, the position of the side lobe where the gain is increased by providing the radome 20A may be adjusted by adjusting the inclination of the transmission side radome 21A with respect to the vertical direction.

Figure 10:
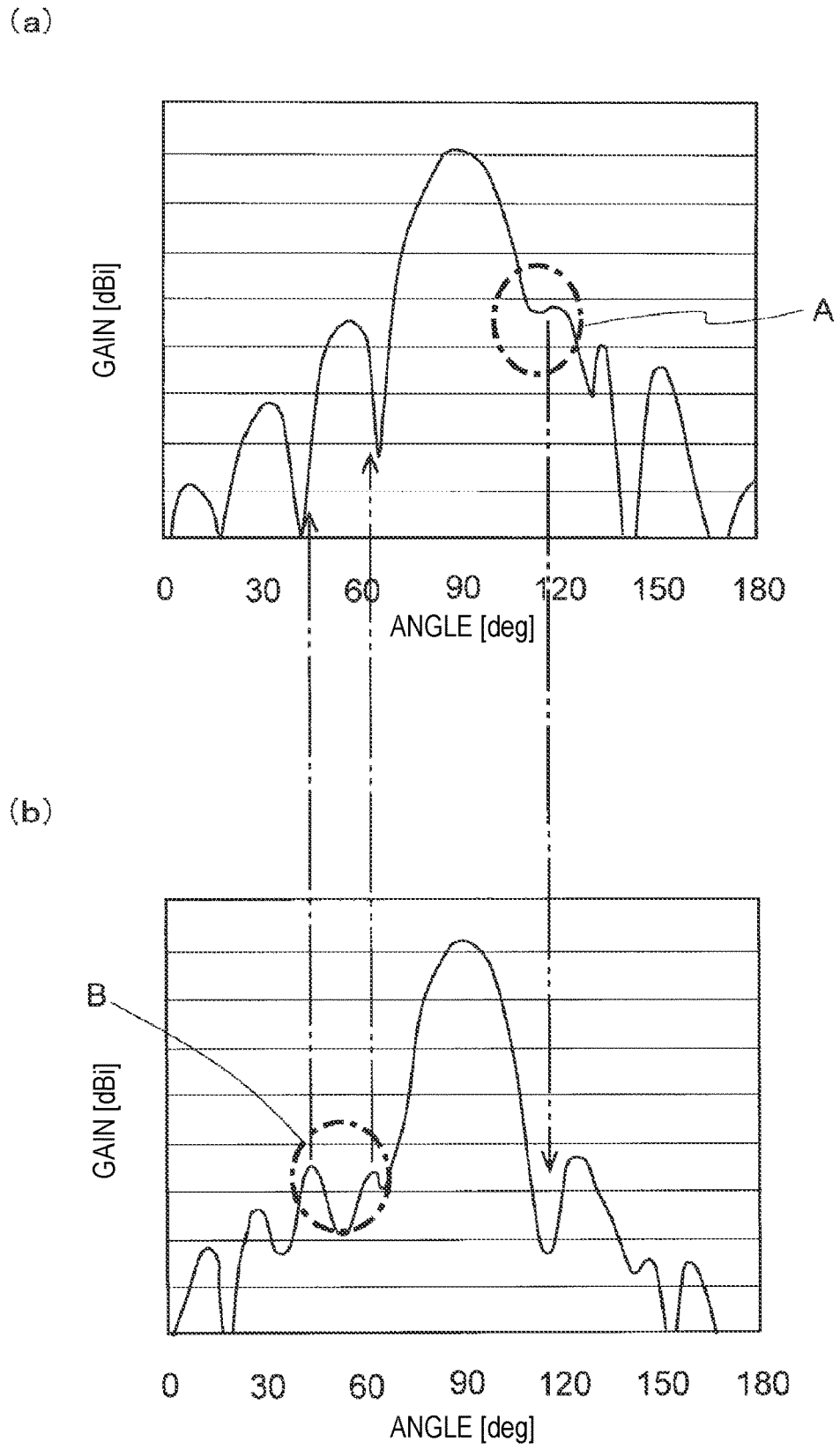
FIG. 10 shows a vertical beam pattern when a radome according to the second embodiment is provided.

In the present embodiment, in consideration of the above-described tendency, the inclination of the transmission side radome 21A and the reception side radome 22A with respect to the vertical direction is determined. FIG. 10 shows a vertical beam pattern when the radome 20A according to the second embodiment is provided. (a) of FIG. 10 shows a vertical beam pattern of the transmission antenna 11. (b) of FIG. 10 shows a vertical beam pattern of the reception antenna 12.

As shown in FIG. 10, the first change region A is located in an angle region at least partially overlapping with an angle region in which a valley is formed in the vertical beam pattern (see (b) of FIG. 10) of the reception antenna 12. Here, in the first change region A, the gain is increased at one side (here, a high angle side) of the main lobe as compared with a case in which the radome 20A is not provided. In the present embodiment, the first change region A is at least partially contained in a side lobe adjacent to the main lobe at the high angle side.

A range in which the first change region A overlaps with the angle region in which the valley is formed in the vertical beam pattern of the reception antenna 12 is preferably as large as possible. The angle region in which the valley is formed in the vertical beam pattern of the reception antenna 12 may change with presence or absence of the radome 20A. Therefore, the first change region A preferably overlaps as much as possible with the angle region in which the valley is formed in the vertical beam pattern of the reception antenna 12 when the radome 20A is provided.

The second change region B is located in an angle region at least partially overlapping with an angle region in which a valley is formed in the vertical beam pattern (see (a) of FIG. 10) of the transmission antenna 11. Here, in the second change region B, the gain is increased at the other side (here, a low angle side) of the main lobe as compared with the case in which the radome 20A is not provided. In the present embodiment, the second change region B is at least partially contained in a side lobe adjacent to the main lobe at the low angle side.

A range in which the second change region B overlaps with the angle region in which a valley is formed in the vertical beam pattern of the transmission antenna 11 is preferably as large as possible. The angle region in which the valley is formed in the vertical beam pattern of the transmission antenna 11 may change with the presence or absence of the radome 20A. Therefore, the second change region B preferably overlaps as much as possible with the angle region in which the valley is formed in the vertical beam pattern of the transmission antenna 11 when the radome 20A is provided.

According to the present embodiment, the first change region A generated in the vertical beam pattern of the transmission antenna 11 overlaps with the angle region in which the valley is formed in the vertical beam pattern of the reception antenna 12, and the second change region B generated in the vertical beam pattern of the reception antenna 12 overlaps with the angle region in which the valley is formed in the vertical beam pattern of the transmission antenna 11. Accordingly, in a transmission reception synthesis vertical beam pattern, the vertical beam pattern may be prevented from changing greatly by providing the radome 20A.

4. Points of Attention

Various technical features disclosed in the present specification may be variously modified without departing from the spirit of the technical creation in addition to the above-described embodiments. The plurality of embodiments and modifications shown in the present specification may be appropriately implemented in combination within a possible range.

In the above description, the inclination angles of the transmission side radomes 21, 21A and the reception side radomes 22, 22A with respect to the antenna surface are controlled to control a change in antenna characteristic by providing the radomes 20, 20A. However, the configuration for controlling the change in antenna characteristic by providing the radome may be another configuration.

Figure 11:
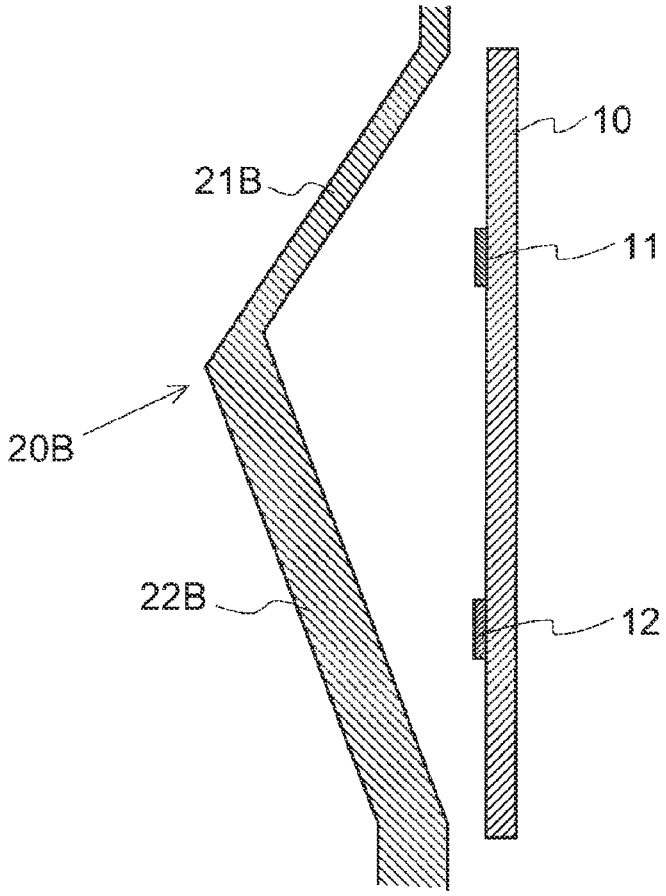
FIG. 11 illustrates a radome according to a first modification.

FIG. 11 illustrates a radome 20B according to a first modification. FIG. 11 also illustrates the substrate 10 to facilitate understanding of a shape of the radome 20B. In the radome 20B according to the first modification, a transmission side radome 21B and a reception side radome 22B have different thicknesses. Accordingly, the reception side radome 22B has a function different from that of the transmission side radome 21B. Specifically, the reception side radome 22B is thicker than the transmission side radome 21B. However, this is merely an example, and the thickness of the reception side radome 22B may be reduced as compared with that of the transmission side radome 21B as necessary.

A reflection intensity of the transmission side radome 21B and a reflection intensity of the reception side radome 22B change according to a change in thickness. A shape of the vertical beam pattern of the transmission antenna 11 and a shape of the vertical beam pattern of the reception antenna 12 may be controlled by adjusting the reflection intensity according to the thickness. Accordingly, a desired beam pattern may be obtained in the transmission reception synthesis vertical beam pattern by providing a difference in thicknesses of the transmission side radome 21B and the reception side radome 22B by adjusting the thicknesses thereof as in the first modification.

A surface (a reflection surface) of at least one of the transmission side radome or the reception side radome facing the substrate may have one of a concavo-convex structure and a curved surface structure. With this configuration, a shape of the vertical beam pattern of the transmission antenna and a shape of the vertical beam pattern of the reception antenna may be controlled more finely.

Figure 12:
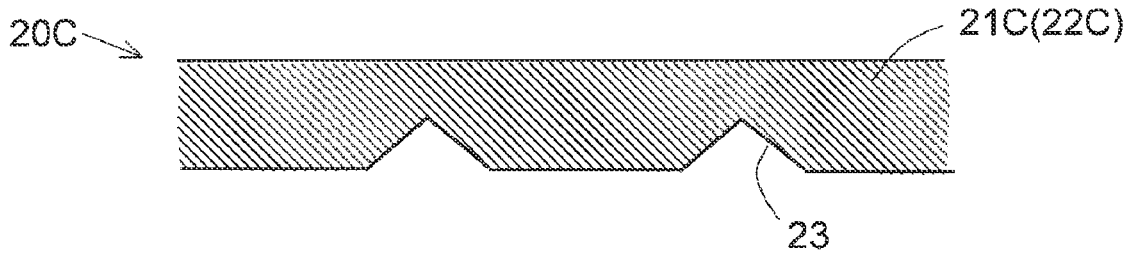
FIG. 12 illustrates a radome according to a second modification.

FIG. 12 illustrates a radome 20C according to a second modification. FIG. 12 illustrates a configuration example when a reflection surface of at least one of a transmission side radome 21C or a reception side radome 22C has a concave-convex structure. FIG. 12 illustrates a part (the transmission side radome 21C or the reception side radome 22C) of the radome 20C.

In an example illustrated in FIG. 12, the reflection surface of the transmission side radome 21C (or the reception side radome 22C) of the radome 20C is formed with at least one concave portion 23. Instead of forming a concave portion in the reflection surface, the reflection surface may be formed with a convex portion. The reflection surface may be formed with a concave portion and a convex portion.

Figure 13:
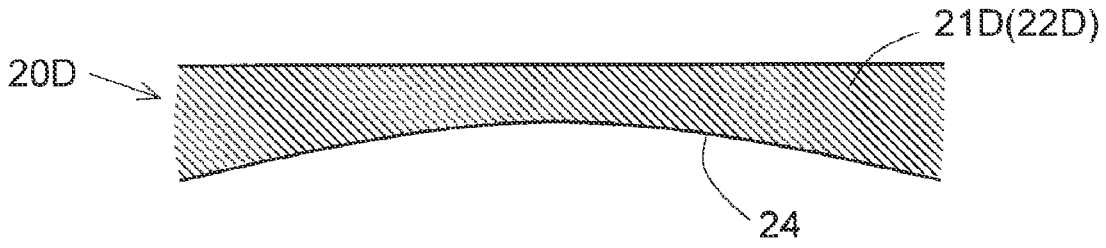
FIG. 13 illustrates a radome according to a third modification.

FIG. 13 illustrates a radome 20D according to a third modification. FIG. 13 illustrates a configuration example when a reflection surface of at least one of a transmission side radome 21D or a reception side radome 22D has a curved surface structure. FIG. 13 illustrates a part (the transmission side radome 21D or the reception side radome 22D) of the radome 20D.

In an example illustrated in FIG. 13, the entire reflection surface of the transmission side radome 21D (or the reception side radome 22D) of the radome 20D is a concave surface 24. Instead of the entire reflection surface being a concave surface, the entire reflection surface may be a convex surface.

In the above description, the transmission antenna 11 and the reception antenna 12 are arranged in the vertical direction, but the present invention is not limited thereto. The transmission antenna 11 and the reception antenna 12 may be arranged obliquely or horizontally. The transmission antenna 11 and the reception antenna 12 may be arranged at different substrates parallel to each other. Also, in this case, the transmission side radome 21 and the reception side radome 22 may be inclined in a predetermined direction with respect to substrates each including antennas facing each other, and the transmission side radome 21 and the reception side radome 22 may be inclined in opposite orientations.

Further, in the above description, the predetermined direction according to the present invention is the vertical direction. However, the predetermined direction according to the present invention may be, for example, an oblique or horizontal direction. For example, the transmission antenna and the reception antenna may include a transmission line extending in the horizontal direction and a plurality of antenna elements that are electrically connected to the transmission line and are arranged in the horizontal direction. The transmission side radome and the reception side radome may be inclined in opposite orientations with respect to the substrate in the horizontal direction.

What is claimed is:

1. An antenna device comprising:

a substrate at which a transmission antenna and a reception antenna are provided; and a radome provided facing the substrate, wherein the radome comprises:

a transmission side radome facing the transmission antenna; and a reception side radome facing the reception antenna, and wherein a region in which a gain is increased as compared with a case in which the radome is not provided in a beam pattern in a plane of the transmission antenna including a predetermined direction and a region in which a gain is increased as compared with a case in which the radome is not provided in a beam pattern in the plane of the reception antenna are at different angular positions, and wherein the beam pattern of the transmission antenna has, at an angular position on one side with respect to a main lobe, a first change region in which a gain is increased as compared with the case in which the radome is not provided, and wherein the beam pattern of the reception antenna has, at an angular position on other side with respect to the main lobe, a second change region in which a gain is increased as compared with the case in which the radome is not provided.

2. The antenna device according to claim 1, wherein the first change region is at least partially contained in a side lobe adjacent to the main lobe in the beam pattern of the transmission antenna, and wherein the second change region is at least partially contained in a side lobe adjacent to the main lobe in the beam pattern of the reception antenna.

3. The antenna device according to claim 2, wherein the first change region is located in an angle region at least partially overlapping with an angle region in which a valley is formed in the beam pattern of the reception antenna, and wherein the second change region is located in an angle region at least partially overlapping with an angle region in which a valley is formed in the beam pattern of the transmission antenna.

4. The antenna device according to claim 1, wherein the first change region is located in an angle region at least partially overlapping with an angle region in which a valley is formed in the beam pattern of the reception antenna, and wherein the second change region is located in an angle region at least partially overlapping with an angle region in which a valley is formed in the beam pattern of the transmission antenna.

5. The antenna device according to claim 1, wherein the transmission side radome and the reception side radome are inclined in the predetermined direction with respect to a surface of the substrate at which the transmission antenna and the reception antenna are provided, and wherein the transmission side radome and the reception side radome are reversely inclined with respect to the substrate.

6. The antenna device according to claim 5, wherein the transmission side radome and the reception side radome are provided symmetrically with respect to a plane orthogonal to the predetermined direction.

7. The antenna device according to claim 6, wherein the radome has a convex shape in which a boundary position between the transmission side radome and the reception side radome is farthest from the substrate in a cross-sectional view of a cut surface orthogonal to the surface of the substrate at which the transmission antenna and the reception antenna are provided.

8. The antenna device according to claim 5, wherein the transmission side radome and the reception side radome are provided asymmetrically with respect to a plane orthogonal to the predetermined direction.

9. The antenna device according to claim 8, wherein the transmission side radome and the reception side radome have different thicknesses.

10. The antenna device according to claim 5, wherein the radome has a convex shape in which a boundary position between the transmission side radome and the reception side radome is farthest from the substrate in a cross-sectional view of a cut surface orthogonal to the surface of the substrate at which the transmission antenna and the reception antenna are provided.

11. The antenna device according to claim 1, wherein the transmission side radome and the reception side radome are inclined in the predetermined direction with respect to a surface of the substrate at which the transmission antenna and the reception antenna are provided, and wherein the transmission side radome and the reception side radome are reversely inclined with respect to the substrate.

12. The antenna device according to claim 11, wherein the transmission side radome and the reception side radome are provided symmetrically with respect to a plane orthogonal to the predetermined direction.

13. The antenna device according to claim 11, wherein the transmission side radome and the reception side radome are provided asymmetrically with respect to a plane orthogonal to the predetermined direction.

14. The antenna device according to claim 13, wherein the transmission side radome and the reception side radome have different thicknesses.

15. The antenna device according to claim 11, wherein the radome has a convex shape in which a boundary position between the transmission side radome and the reception side radome is farthest from the substrate in a cross-sectional view of a cut surface orthogonal to the surface of the substrate at which the transmission antenna and the reception antenna are provided.

16. The antenna device according to claim 1, wherein a surface of at least one of the transmission side radome or the reception side radome facing the substrate has a concavo-convex structure or a curved surface structure.

17. The antenna device according to claim 1, wherein a surface of at least one of the transmission side radome or the reception side radome facing the substrate has a concavo-convex structure or a curved surface structure.

18. The antenna device according to claim 1, wherein the transmission antenna and the reception antenna comprise a transmission line and a plurality of antenna elements electrically connected to the transmission line, and wherein the plurality of antenna elements are arranged along the predetermined direction.

19. The antenna device according to claim 1, wherein the transmission antenna and the reception antenna comprise a transmission line and a plurality of antenna elements electrically connected to the transmission line, and wherein the plurality of antenna elements are arranged along the predetermined direction.

* * * * *